US005181292A

United States Patent [19]

Aghachi

[11] Patent Number: 5,181,292

[45] Date of Patent: Jan. 26, 1993

[54] CLEANING CARTRIDGE FOR VIDEO GAMES AND COMPUTERS

[76] Inventor: Abraham Aghachi, 11724 Santa Monica Blvd., West Los Angeles, Calif. 90024

[21] Appl. No.: 670,076

[22] Filed: Mar. 15, 1991

[51] Int. Cl.[5] ..... B08B 11/00; B24P 15/02

[52] U.S. Cl. ..... 15/236.08; 15/236.05; 51/205 WG; 360/128; 360/137

[58] Field of Search ..... 15/236.08, 236.01, 236.05; 360/128, 137; 51/205 WG, 392

[56] References Cited

U.S. PATENT DOCUMENTS 3,777,330 12/1973 Van Huffel ..... 15/421

4,558,517 12/1985 Gringer ..... 15/236.01 X 4,951,425 8/1990 Naghi ..... 15/210 R X 4,993,100 2/1991 Halboth et al. ..... 15/118

5,025,526 6/1991 Ichitsubo et al. ..... 15/210 R

*Primary Examiner*—Chris K. Moore

*Attorney, Agent, or Firm*—Boniard I. Brown

[57] ABSTRACT

A device for cleaning electrical contacts located within a cartridge receptacle of a video game. A manually-manipulable housing containing a slidable cleaner blade element is insertable into the receptacle, after which the blade element is moved back and forth to exert a scraping action on the electrical contacts; the housing is held stationary within the receptacle during the cleaning operation.

22 Claims, 3 Drawing Sheets

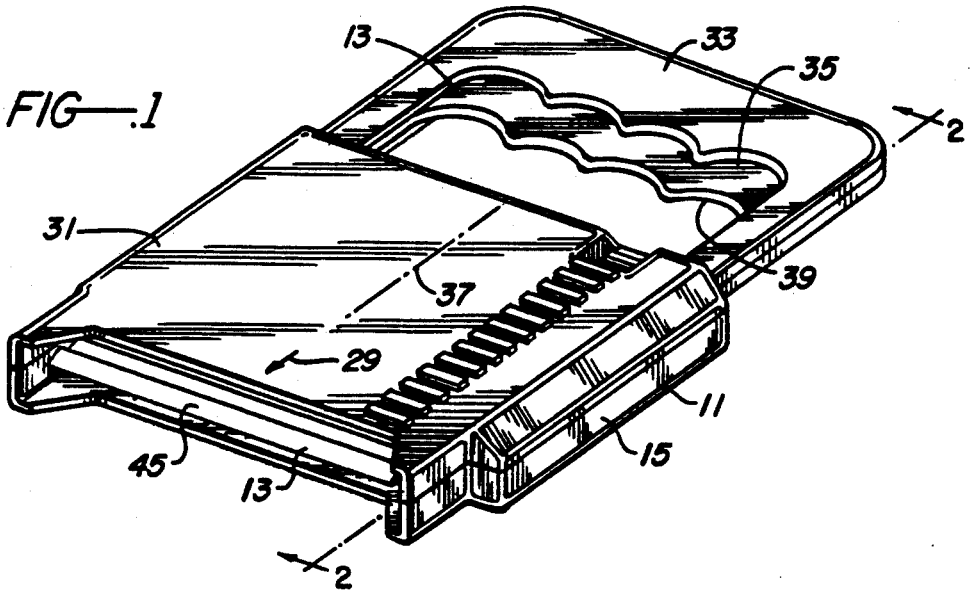
FIG—.1
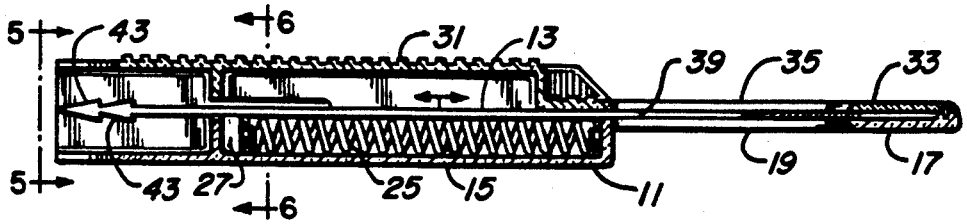
FIG—.2
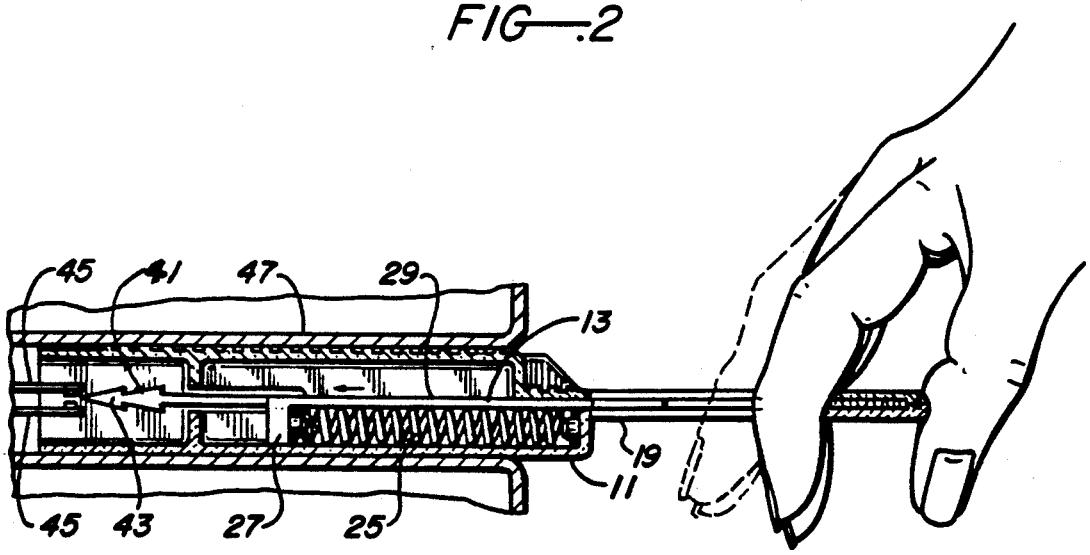
FIG—.3

FIG—.4
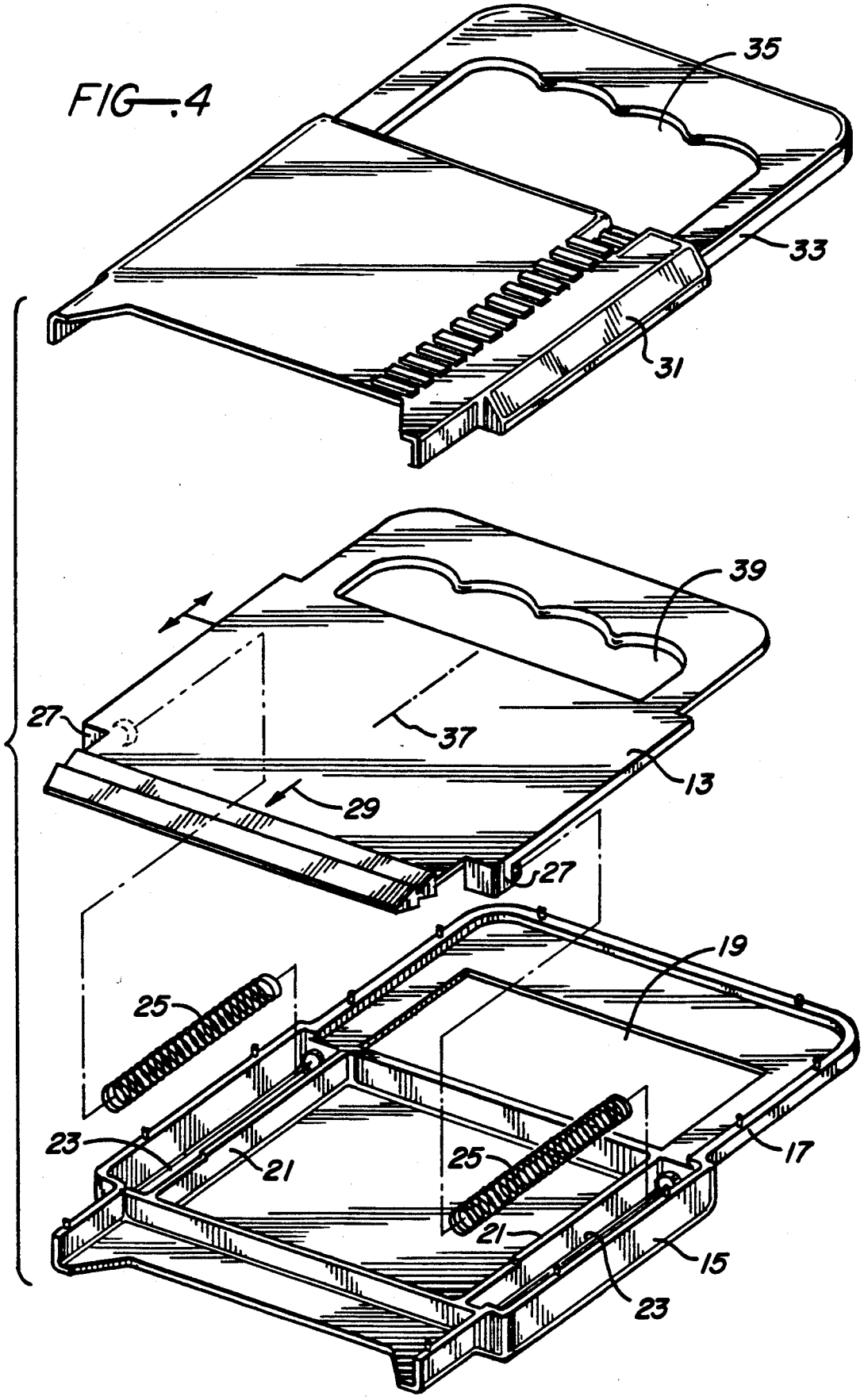

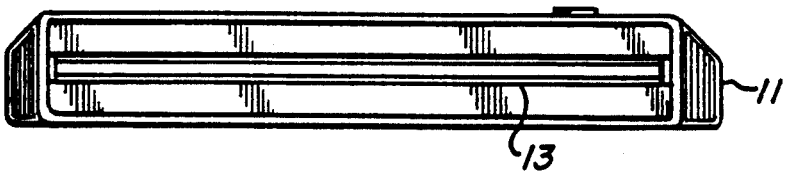
FIG—.5
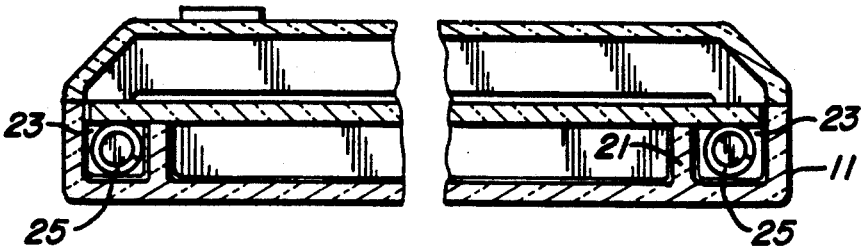
FIG—. 6
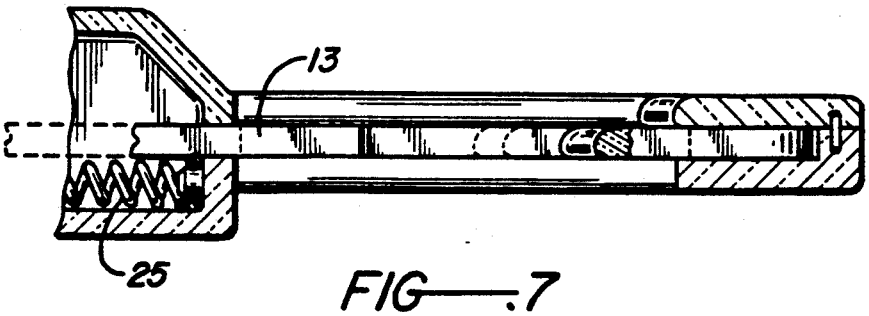
FIG—.7
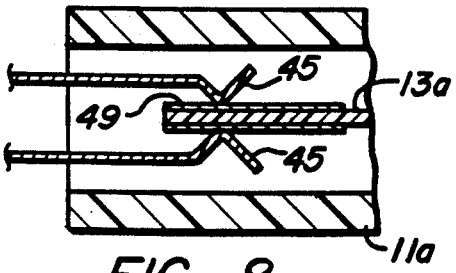
FIG—.8
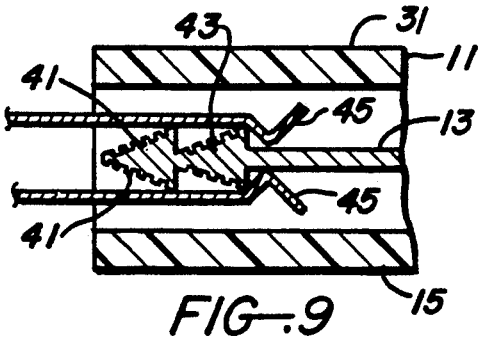
FIG—.9
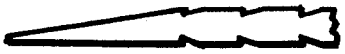
FIG—.10
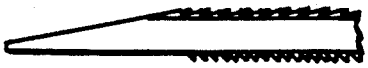
FIG—.11
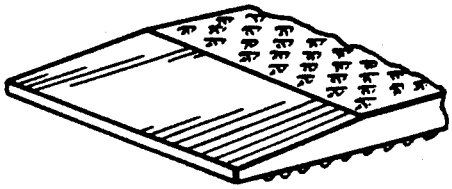
FIG—.12

CLEANING CARTRIDGE FOR VIDEO GAMES AND COMPUTERS

BACKGROUND OF THE INVENTION

The present invention relates to devices for cleaning electrical contacts within computer or video game cartridge receptacles.

A variety of prior art devices have been provided for the cleaning, gauging, etc. of electrical contacts. Those of interest include the prior devices disclosed in U.S. Pat. No. 1,554,117 to Moore, U.S. Pat. No. 3,807,012 to Semrad, U.S. Pat. No. 4,916,564 to Fritsch, and U.S. Pat. No. 3,141,270 to Ferrand.

The prior art of interest known to applicant relative to the cleaning of electrical contacts in receptacles of computers and video game devices are U.S. Pat. No. 4,663,686 to Freeman, et al., and U.S. Pat. No. 4,951,425 to Naghi. The Freeman device is a cleaning cartridge insertable into a computer receptacle for cleaning the contacts of a disk drive head, the cleaning cartridge being insertable into the receptacle and having a head wiper pad on a flat member and reciprocably movable transversely of the direction of cartridge insertion, by manual operation of a lever to clean the disk drive head.

U.S. Pat. No. 4,951,425 to Naghi relates to a cleaning cartridge for the cleaning of the electrical contacts of a printed circuit board within the cartridge receptacle of a video game device. The cartridge includes a flat planar board extending within a manually manipulable housing adapted to be slidably inserted into a female receptacle in a video game housing. A leading edge area of the flat board has thereon a commercially available film of abrasive lapping material. During insertion of the cartridge into the video game housing, the lapping film on the planar board comes into engagement with electrical contacts mounted within the video game housing to provide a cleaning action on the contacts. The specification of the patent indicates that the leading edge of the board has the same location and configuration as the leading edge of the board involved in playing a video game (column 3, lines 9 and 10 of the patent specification); the engagement between the board and the electrical contacts is the same during the cleaning operation as during the game playing operation. The effectiveness of the cleaning operation is therefore dependent solely upon the surface character of the board—i.e., the lapping film on the board.

The utilizing of a lapping or fine abrasive film on a conventional cartridge board is not conducive to thorough cleaning of electrical contacts. The engagement of the board with contacts is quite limited, so that only a minor portion of the debris is removed from the contacts. Further, the cleaning pressure is relatively slight, this being the same pressure which exists between the electrical contacts and the contact surfaces on the game board. Further, the sliding velocity of the cleaning board into the receptacle is relatively slow, so that abrasive action of the lapping film is relatively slight.

The present invention relates to a mechanism for cleaning opposed spaced electrical contacts in a computer or video game cartridge receptacle. A specially formed blade is slidably mounted in a manually manipulable housing. The leading edge of the blade has a plurality of projecting teeth thereon adapted to provide a scraping action on the electrical contact when the blade is moved back and forth. The teeth have sharp edges which ride along the surfaces of the electrical contacts to scrape debris from the contact surfaces. The stroke of the blade is relatively long, thus to provide a substantial cleaning action for each stroke. The teeth project from the general plane of the blade to deflect and spread the contacts apart substantially, thus producing relatively high engagement pressures between the cleaning teeth and the electrical contact surfaces, thereby producing increased cleaning effects. The mechanism produces a cleaning action superior to the action produced by such devices as that of U.S. Pat. No. 4,951.425.

BRIEF DESCRIPTION OF THE DRAWINGS

FIG. 1 is a perspective view of a cleaning device according to the present invention;

FIG. 2 is a sectional view taken on line 2—2 in FIG. 1;

FIG. 3 is a view similar to that of FIG. 2, but showing the device in a different condition of adjustment;

FIG. 4 is an exploded perspective view of the device of FIG. 1;

FIG. 5 is an end view of the device of FIG. 1, taken at line 5—5 in FIG. 2;

FIG. 6 is a transverse sectional view taken on line 6—6 in FIG. 2;

FIG. 7 is a fragmentary sectional view taken through structural detail utilized with the device of FIG. 1;

FIG. 8 is a fragmentary sectional view through a structural detail utilized in a prior art device;

FIG. 9 is a sectional view taken in the same direction as FIG. 8, but showing a similar structural detail of the device of FIG. 1;

FIGS. 10 and 11 are sectional views of the front portions of blades utilized with the invention, showing certain forms of inclined surface areas for teeth which may be utilized on the blades; and FIG. 12 is a perspective view of the front portion of a blade which may be utilized with the invention, showing an arrangement of separate spaced inclined teeth or surface areas.

DESCRIPTION OF A PREFERRED EMBODIMENT OF THE INVENTION

FIG. 1 and 4 illustrate a device according to the present invention, comprising a manually-manipulable housing 11 containing a slidable blade structure 13. Housing 11 includes a lower hollow housing element 15 having a handle-like extension 17 with a rectangular hole 19 formed therethrough. Two internal partitions 21 in housing element 15 serve to define two narrow chambers 23 to confine therewithin two coil springs 25. One end of each spring engages a lug 27 that depends from blade structure 13. Springs 25 bias blade structure 13 in the direction of arrow 29 of FIGS. 1 and 4.

Housing 11 further includes an upper housing element 31 having a handle-like extension 33 with a hand-hold opening 35 formed therein. The blade structure 13 is sandwiched between the two housing elements 15 and 31, and the two housing elements are secured together along their mating peripheral edges by conventional adhesives. Blade structure 13 is slidable within the housing for movement along its central axis 37. Springs 25 normally bias the blade structure to its position shown in FIGS. 1 and 2, in which position a hand-access opening 39 in the blade structure is slightly out of registration with the hand openings in the blade housing. A person can move the blade against the biasing action of springs 25 by extending the fingers through the access openings and exerting a squeezing pressure on an edge of access opening 39, as shown generally in FIG. 3. The blade is thereby drawn rightwardly, as viewed in FIG. 3, to a retracted position. When the manual squeezing force is relieved, springs 25 bias the blade leftwardly to its FIG. 2 position.

The left edge of blade 13, as viewed in FIGS. 2, 3 and 9, constitutes the leading edge of the blade, and face areas 41 of the blade near the leading edge are acutely inclined or angled to the general plane of the blade, thus to form V-shaped teeth 43. These teeth have a transverse thickness (FIG. 9) which is substantially greater than the normal spacing of opposed electrical contacts 45 located within a conventional video game cartridge receptacle 47 (FIG. 3). When housing 11 is manually inserted into receptacle 47, the V-shaped teeth 43 extend into the space between contacts 45 and deflect the contacts apart as the blade is reciprocated back and forth within housing 11. The reciprocatory blade movement is accomplished with housing 11 stationary after its insertion into receptacle 47.

A manual pulling force on the blade retracts the blade, and when the manual force is relieved springs 25 urge the blade leftwardly to its extended position. During the back and forth motion of the blade, the surfaces of teeth 43 scrape against the surfaces of electrical contacts 45 to exert a cleaning action thereon. The teeth deflect the leaf spring electrical contacts 45 apart to a greater extent than indicated in FIG. 9, thereby producing increased engagement pressure between the contacts and the scraper teeth, thus providing an enhanced scouring and cleaning action of the teeth on the electrical contact surfaces. Outer tip areas of the teeth are sharpened to a relatively sharp edge, thereby further promoting a good scouring action.

FIGS. 10, 11 and 12 illustrate certain forms of inclined surface areas or teeth to be utilized to effect cleaning action on electrical contact surfaces in a machine receptacle. FIG. 10 shows a form wherein a plurality of inclined teeth extend longitudinally of the front edge portion of the board to provide continuous scraping action during movement of the board. FIG. 11 illustrates a form wherein the teeth are not in continuous transverse rows but are staggered transversely of the front edge portion of the board to provide thorough scraping action. FIG. 12 shows in perspective an arrangement wherein individual inclined teeth or inclined surfaces are spaced about the front edge portion of the board, somewhat like those of a cheese grater.

Springs 25 may be relatively strong springs capable of moving blade 13 at reasonably high velocity to enable teeth 43 to exert a substantial frictional abrading force on the electrical contact surfaces. The abrading action may be enhanced by providing grooves in the teeth surfaces, similar to the grooves defined in conventional files for defining cutting edges. Blade 13 can be formed of metal or of a hard wear-resistant plastic material.

FIG. 8 is a view similar to FIG. 9, but taken through a prior art device arrangement like that of U.S. Pat. No. 4,951,425, and showing a blade of the prior art device in its extended position. The blade 13*a* is rigidly connected to housing 11*a*, so that movement of the blade to its retracted position requires rightward withdrawal of the housing at least partially out of the video game housing. Two lapping films 49 containing abrasive particles are formed on blade 13*a* so that retractive (rightward) motion of the blade causes films 49 to exert a scraping action on electrical contacts 45. However, it will be noted that the film length in slidable engagement with contacts is relatively slight (only about one-third the film length, as viewed in FIG. 8, or only about one-fourth of an inch in an actual device. Further, the films 49 have very limited area engagement with the electrical contact surfaces, principally at the inner convergent portions of the contacts. Debris and corrosion on other portions of the contacts is not touched.

A further disadvantage of the prior art arrangement of FIG. 8 arrangement is that movement of blade 13*a* can only be accomplished by bodily moving housing 11*a* in or out of the cartridge receptacle. In the FIG. 8 position, the blade is in an at-rest position at the limit of its leftward motion. Initial motion of the blade is relatively slow because both the blade and the housing 11*a* have to be accelerated by a manual pulling action on the housing. Similarly, in the reverse (leftward) direction, both the housing and the blade have to be accelerated manually together by a pushing action on the housing. A person is not likely to move the housing with any substantial velocity, for fear that substantial manual force might cause the housing to forcibly impact against internal portions of the receptacle 47, thereby damaging the mechanism. With the squeeze-release action utilized with the device of the invention (FIG. 3), the blade develops substantial velocities in both directions. Only the blade is moved, while the housing 11 remains stationary in the receptacle during the cleaning operation.

Thus there has been shown and described a novel cleaning cartridge for video games and computers which fulfills all the objects and advantages sought therefor . Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A device for cleaning opposed spaced electrical contacts within a computer or video game cartridge receptacle, said cleaning device comprising:

a manually manipulable housing adapted for slidable insertion into a cartridge receptacle, and a blade slidably mounted in said housing for motion parallel to the direction of housing insertion, said blade having a leading edge portion with at least one face area adapted to clean electrical contacts within the cartridge receptacle, said blade having a hand access opening for manual squeezing action on an edge portion of said blade access opening to move the blade relative to the electrical contacts, whereby manual movement of the blade causes said at least one face area to scrape against and clean the electrical contacts to provide a cleaning action.

2. A cleaning device according to claim 1, wherein:

said blade has a retracted position withdrawn from engagement with the electrical contacts, and an extended position in engagement with the electrical contacts.

3. A device for cleaning opposed spaced electrical contacts within a computer or video game cartridge receptacle, said cleaning device comprising:

a manually manipulable housing adapted for slidable insertion into a cartridge receptacle, and a blade slidably mounted in said housing for motion parallel to the direction of housing insertion, said blade having a leading edge portion adapted to extend between the opposed electrical contacts within the cartridge receptacle, said blade having a retracted position withdrawn from engagement with the electrical contacts and an extended position in engagement with the electrical contacts, whereby manual reciprocating movement of the blade within the housing causes its leading edge area to scrape against the electrical contacts to provide a cleaning action, springs means trained between the blade and the housing to bias the blade to its extended position.

4. A cleaning device according to claim 3, wherein:

said spring means comprises two spaced springs extending parallel to the blade slide.

5. A cleaning device according to claim 3, wherein:

said blade has a centerline defining a blade slide axis, said blade has two lugs extending therefrom in spaced relation to the blade centerline, and said spring means comprises two coil springs extending parallel to the blade centerline in axial alignment with said lugs.

6. A device for cleaning opposed spaced electrical contacts within a computer or video game cartridge receptacle, said cleaning device comprising:

a manually manipulable housing adapted for slidable insertion into a cartridge receptacle, and a blade slidably mounted in said housing for motion parallel to the direction of housing insertion, said blade having a leading edge portion adapted to extend between the opposed electrical contacts within the cartridge receptacle, whereby manual reciprocating movement of the blade within the housing causes its leading edge area to scrape against the electrical contacts to provide a cleaning action, surface areas of the blade leading edge portion are inclined relative to the general plane of the blade, whereby during reciprocating motion of the blade the inclined surface areas ride on the electrical contacts to exert a scraping action thereon.

7. A cleaning device according to claim 6, wherein:

the inclined surface areas of the blade form knife edges to engage the electrical contacts.

8. A cleaning device of claim 6, wherein:

the inclined surface areas of the blade are V-shaped in cross sectional configuration.

9. A cleaning device according to claim 8, wherein:

said inclined surface areas of the blade comprise a plurality of inclined teeth with sharp edges extending longitudinally of the front edge portion of the blade for cleaning electrical contacts during blade movement.

10. A cleaning device according to claim 9, wherein:

said inclined teeth are staggered in non-aligned relation transversely of the front edge portion of the blade.

11. A cleaning device according to claim 8, wherein:

the inclined teeth comprise a plurality of separate individual inclined surfaces spaced about the surface of the front edge portion of the blade.

12. A cleaning device according to claim 1, wherein:

face areas of the blade extending from the blade leading edge portion have thereon a plurality of V-shaped teeth, the transverse thickness of the teeth being substantially greater than the normal spacing of the electrical contacts, whereby the opposed contacts are forced apart during reciprocal back-and-forth motion of the blade.

13. A cleaning device according to claim 1, wherein:

said housing has a hand opening extending therethrough, and said blade has a hand access opening movable into registration with the housing hand access opening upon manual squeezing action on an edge area of the blade hand access opening.

14. A cleaning device according to claim 13, wherein:

said blade has a retracted position withdrawn from engagement with the electrical contacts, and an extended position in engagement with the electrical contacts, the hand access opening in the blade being in registration with the housing hand access opening when the blade is in its retracted position.

15. A cleaning device according to claim 14, and further comprising:

a spring means trained between the blade and the housing to bias the blade to its extended position.

16. A cleaning device according to claim 6, wherein:

said inclined surface areas of the blade comprise a plurality of inclined teeth with sharp edges extending longitudinally of the front edge portion of the blade for cleaning electrical contacts during blade movement.

17. A cleaning device according to claim 16, wherein:

said inclined teeth are staggered in non-aligned relation transversely of the front edge portion of the blade.

18. A cleaning device according to claim 6, wherein:

the inclined teeth comprise a plurality of separate individual inclined surfaces spaced about the surface of the front edge portion of the blade.

19. A cleaning device according to claim 1, and further comprising:

means normally biasing the blade to its extended position to return the blade to its extended position after manual movement of the blade from the extended position.

20. A cleaning device according to claim 3, and further comprising:

means normally biasing the blade to its extended position to return the blade to its extended position after manual movement of the blade from the extended position.

21. A cleaning device according to claim 1, wherein:

said at least one leading edge portion face area comprises a plurality of inclined teeth for scraping the electrical contacts upon relative movement between the blade and the electrical contacts.

22. A cleaning device according to claim 1, wherein:

the housing has a hand access opening therethrough, said housing hand access opening being generally in registration with the blade access opening upon manual squeezing action on the blade to urge it into a retracted position.

* * * * *